US006283070B1

(12) United States Patent
Deckard et al.

(10) Patent No.: US 6,283,070 B1
(45) Date of Patent: Sep. 4, 2001

(54) APPARATUS AND METHOD FOR SEALING INTERNAL COMBUSTION ENGINES

(76) Inventors: Carl Robert Deckard; Dimitrios Dardalis, both of 720 Hwy., Suite 108, Austin, TX (US) 78741

( * ) Notice: Subject to any disclaimer, the term of this patent is extended or adjusted under 35 U.S.C. 154(b) by 0 days.

(21) Appl. No.: 09/360,061

(22) Filed: Jul. 23, 1999

(51) Int. Cl.[7] ..... F02B 57/00

(52) U.S. Cl. ..... 123/43 R; 277/458; 277/468; 277/472

(58) Field of Search ..... 123/43 R, 44 R, 123/50 R, 50 A, 50 B; 277/437, 438, 458, 467, 468, 480, 481, 472, 477, 488, 474

(56) References Cited

U.S. PATENT DOCUMENTS

| | | | | |
|---|---|---|---|---|
| 876,853 | * | 1/1908 | Wille | 277/468 |
| 2,160,654 | * | 5/1939 | Hagen | 277/458 |
| 2,360,568 | * | 10/1944 | McAllister | 277/458 |
| 2,968,501 | * | 1/1961 | Tisch | 277/472 |
| 3,319,615 | * | 5/1967 | Girerd | 123/43 R |
| 3,839,996 | * | 10/1974 | DeBiasse | 277/468 |
| 3,841,644 | * | 10/1974 | White | 277/468 |
| 4,577,874 | * | 3/1986 | Zitting | 277/468 |

FOREIGN PATENT DOCUMENTS

| | | | | |
|---|---|---|---|---|
| 2559200 | * | 7/1977 | (DE) | 123/43 R |

* cited by examiner

*Primary Examiner*—Michael Koczo
(74) *Attorney, Agent, or Firm*—Rick B. Yeager

(57) ABSTRACT

An improved sealing means for internal combustion engines comprising a combination of a metal primary sealing ring positioned substantially within a groove on the piston, and a compliant secondary sealing ring positioned in the groove behind the primary compression ring so that the compressed combustion gases force the compliant secondary sealing ring to form a seal between the groove and the primary sealing ring. In the preferred embodiment, the gapped ring is non-planar in order to provide effective sealing in a ported fixed-piston, rotating and translating cylinder engine such as the Deckard engine. Alternate embodiments include gapless rings with only a primary compression ring, and gapless rings with a compliant secondary sealing ring. An alternate embodiment is a single piece metal-capped compliant secondary sealing ring.

7 Claims, 9 Drawing Sheets

APPARATUS AND METHOD FOR SEALING INTERNAL COMBUSTION ENGINES

RELATED APPLICATION

U.S. patent application Ser. No. 08/949,447 for a "Rotating/reciprocating cylinder positive displacement device" was filed by inventor Carl R. Deckard on Oct. 13, 1997.

FIELD OF INVENTION

This invention relates to novel and improved ring design for sealing internal combustion engines. The ring design includes non-planar and secondary sealing embodiments.

BACKGROUND

The clearance between the cylinder and piston of an internal combustion engine needs to be maintained at least a minimum level in order to allow freedom of motion and to provide space for thermal expansion. This clearance is typically too high to provide an effective gas sealing. Thus, piston rings, typically in the form of pressure activated seals, are generally provided around the top of the piston to limit blowby of combustion products. Those familiar in the art recognize that a typical piston ring is split and its natural diameter is slightly larger than the cylinder in order to provide the pre-load when in place so that it naturally acts against the into cylinder wall.

The current invention improves the performance of piston rings in conventional internal combustion engines where a moving piston reciprocates within a fixed piston.

The invention also provides improved sealing on ported engines such as the Deckard engine where a cylinder rotates and reciprocates relative to a fixed piston.

The Deckard engine is an engine design that operates on the four-stroke cycle but with only one moving part. The Deckard engine is a very cost effective design for small applications where the four-stroke cycle is preferred over the two stroke.

Internal combustion engines are typically either two-stroke engines or four-stroke engines. For small engine applications such as model engines, chain saws, lawn trimmers, leaf blowers, and off road vehicles, two-stroke engines are often employed because of their lower weight, relative simplicity, lower cost, and high power to weight ratio relative to four-stroke engines.

Two-stroke engines, however, have inherently higher pollutant emissions than four-stroke engines because oil must be added to the fuel, and because the intake charge is incompletely burned. Another disadvantage of two-stroke engines is the relatively poor fuel efficiency, which results from this incomplete burning of fuel. Two-stroke engines are typically run "rich" which means that more fuel will be introduced than can be stoichiometrically combined with the oxygen provided. For instance, four-stroke engines will typically be run at air to fuel mass ratios of 13:1 to 15:1, while two-stroke engines may be run at a ratio of 10:1. Since this ratio is substantially below the stoichiometric ratio of about 14.8:1 for gasoline, it is impossible to burn all of the fuel introduced. The results of this incomplete combustion are reduced fuel economy and increased emissions.

From the consumer's perspective, the general advantages of four-stroke engines relative to two-stroke engines include: that there is no requirement to add oil to the fuel, that the smell is not as bad, that the engines are less noisy, that the engines are easier to start, that the engines provide better low-end torque, and that the engines run better at idle.

Four-stroke engines have improved emissions relative to two-stroke engines because they do not require the addition of oil to the fuel, and because they have more complete combustion. On the other hand, four-stroke engines typically require more moving parts than two-stroke engines.

For the foregoing reasons, there is a need for a simple, low cost, four-stroke engine. The preferred embodiment of this invention is a four-stroke ported internal combustion engine. The preferred embodiment provides a four-stroke engine with one major moving part, and few parts that require machining. In this embodiment, a cam means is used to link the rotation and translation of the cylinder relative to a generally fixed piston; and the rotation accomplishes the functions of a rotary valve, while the translation accomplishes the change of volume function. A transfer port, which is a recess in the cylinder wall, provides a path for intake of fuel and air through the intake port, as well as exhaust of combustion products through the exhaust port.

The preferred embodiment presented is a single cylinder, four-stroke internal combustion engine which comprises a cylindrical piston and a cylinder that rotates and reciprocates with respect to the piston. As the cylinder completes a revolution around the piston, a cam integral to the cylinder rotates through fixed cams and causes the cylinder to reciprocate through exhaust, intake, compression, and power strokes relative to the piston. These strokes correspond generally to the four-strokes of a conventional engine. A transfer port within the cylinder facilitates the intake of fuel and the exhaust of combustion products. The cylinder may include a cam and followers to control the cylinder movement.

Published past experimentation results establish that improving the secondary sealing can reduce hydrocarbon emissions. In those experiments, the conventional ring-pack of a spark ignition engine was replaced by a ring which was relatively wide in the direction parallel to the axis of symmetry of the piston ring, and that fitted relatively tightly on a similarly wide groove. The ring was pre-loaded by three round O-rings positioned one above the other. This prior art design has some disadvantages with respect to the current invention. The relatively tall ring which was at least twice the height of the of 1.5 to 2 mm conventional engines compression ring, will create a relatively large hydrodynamic drag. An objective of the current invention is to use a ring of approximate conventional height in order to minimize hydrodynamic drag. A second limitation of the prior art is that three O-rings and the tight piston-ring fit limits the pressure actuation of that design which is likely to compromise the sealing action at high loads and high cylinder pressures. Another objective of the current invention is to permit effective pressure activation of the rings.

SUMMARY OF THE INVENTION

This invention relates to novel and improved ring design for sealing internal combustion engines. The ring design includes non-planar and secondary sealing embodiments.

An improved sealing means for internal combustion engines comprising a combination of a metal primary sealing ring positioned substantially within a groove on the piston, and a compliant secondary sealing ring positioned in the groove behind the primary compression ring so that the compressed combustion gases force the compliant secondary sealing ring to form a seal between the groove and the primary sealing ring. In the preferred embodiment, the gapped ring is non-planar in order to provide effective sealing in a ported fixed-piston, rotating and translating cylinder engine such as the Deckard engine. Alternate embodiments include gapless rings with only a primary compression ring, and gapless rings with a a compliant secondary sealing ring. An alternate embodiment is a single piece metal-capped compliant secondary sealing ring.

The current invention improves the performance of piston rings in conventional internal combustion engines where a moving piston reciprocates within a fixed cylinder.

The invention also provides improved sealing on ported engines such as the Deckard engine where a cylinder rotates and reciprocates relative to a fixed piston.

DESCRIPTION OF DRAWINGS

The above-mentioned and other objects and features of the present invention will become apparent from a reading of the following detailed description with reference to the accompanying drawings, in which.

DESCRIPTION OF PREFERRED EMBODIMENT-THE DECKARD ENGINE

WITH GAPPED NON-PLANAR RING WITH SECONDARY SEAL

The preferred embodiment of this invention is a single-cylinder, four-stroke, internal combustion engine with a moving cam and fixed cams.

Figure 4:
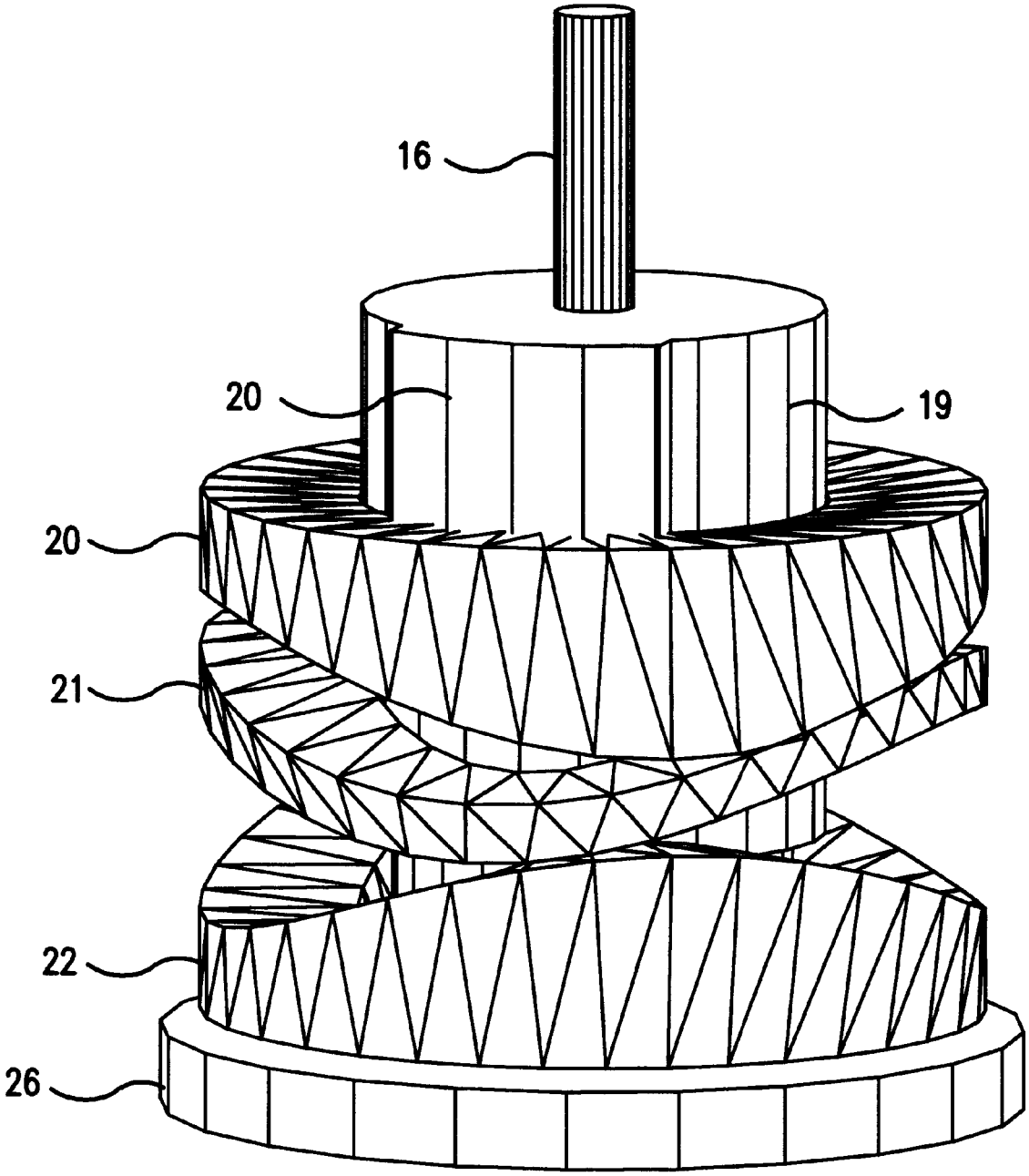
FIG. 4 shows a side view of the Deckard engine.

FIG. 4 shows a side view of the engine. A relatively fixed piston, not seen in this figure, is attached to a support structure 26, which is a part of an external device. A cylinder 19 rotates and reciprocates relative to the piston. The path of the cylinder is determined by a moving cam 21 which is attached or integral to the cylinder. As the cylinder rotates, the moving cam moves between a front fixed cam 20 which is attached to the support structure but which is not attached to the cylinder, and a back fixed cam 22, which is attached to the support structure but which is not attached to the cylinder. The cylinder and the shaft 16 have both a rotational and a reciprocating component. The external device will generally couple to the rotational component of the cylinder movement, and that coupling detail is not included in the preferred embodiment.

Figure 5:
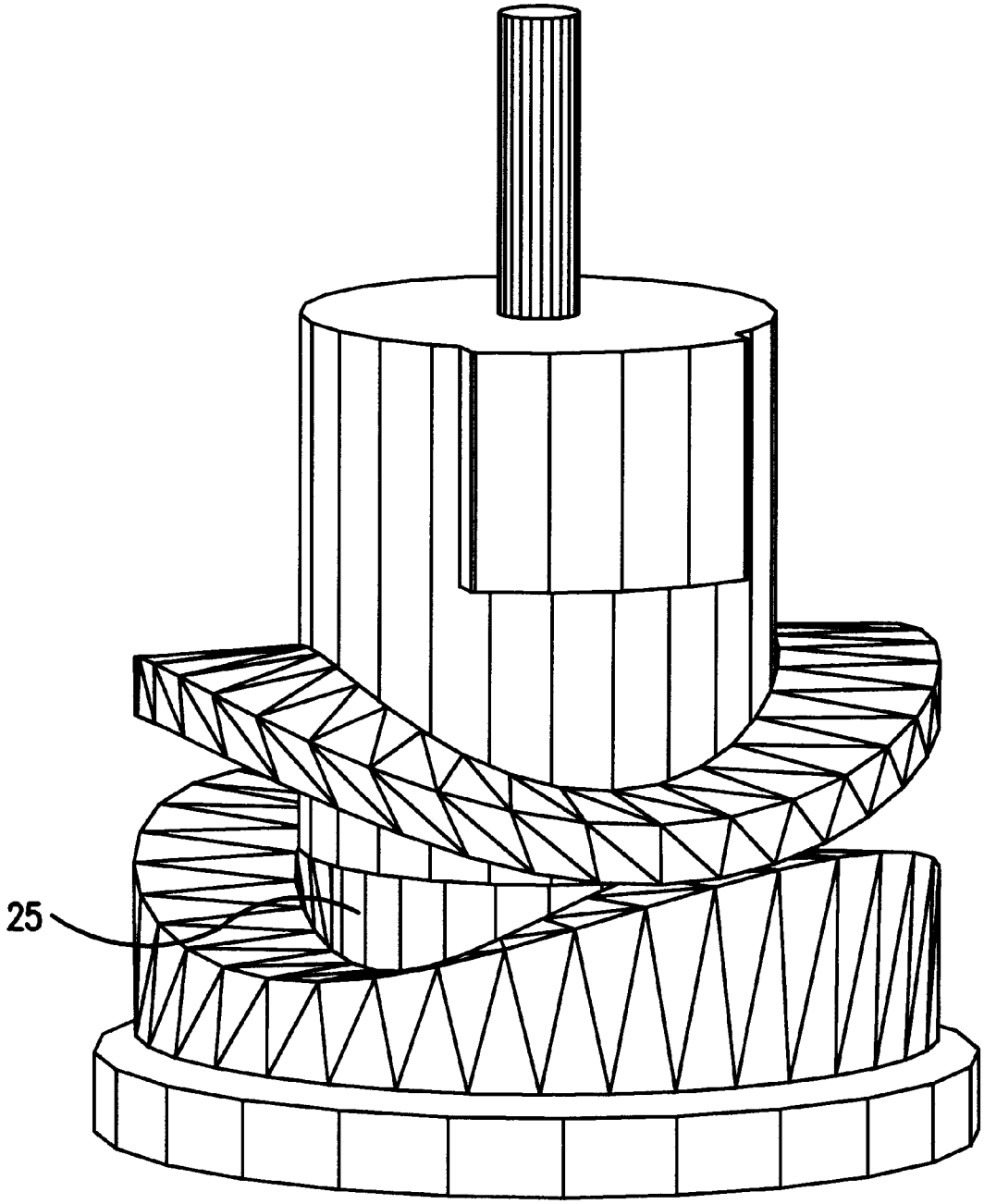
FIG. 5 shows a side view of the Deckard engine with the front fixed cam removed for clarity, and with the cam rotated to a different orientation than FIG. 4.

FIG. 5 shows a side view of the engine with the front fixed cam removed for clarity, and with the cam rotated to a different orientation than FIG. 4. A portion of the relatively fixed piston 25 can be seen in this figure.

Figure 6:
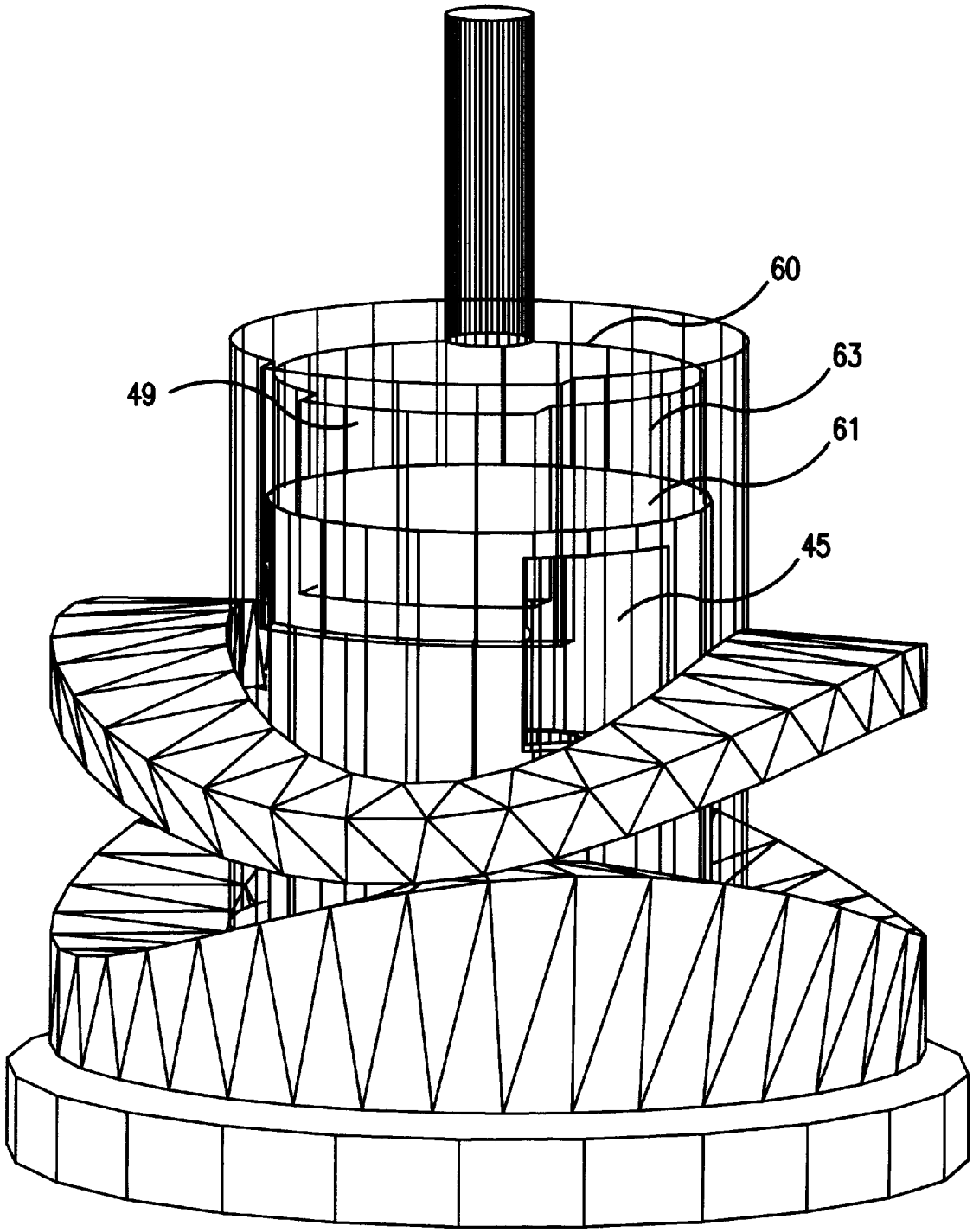
FIG. 6 shows a hidden line view of the Deckard engine.

FIG. 6 shows a hidden line view of the engine. A combustion chamber 63 is formed between the closed end of the cylinder 60 and the piston top 61. In this view the transfer port 49 has rotated past the exhaust port 45. Earlier in the cycle, the fuel had been permitted to enter the combustion chamber through the transfer port at the time that the transfer port overlapped the intake port.

Figure 7:
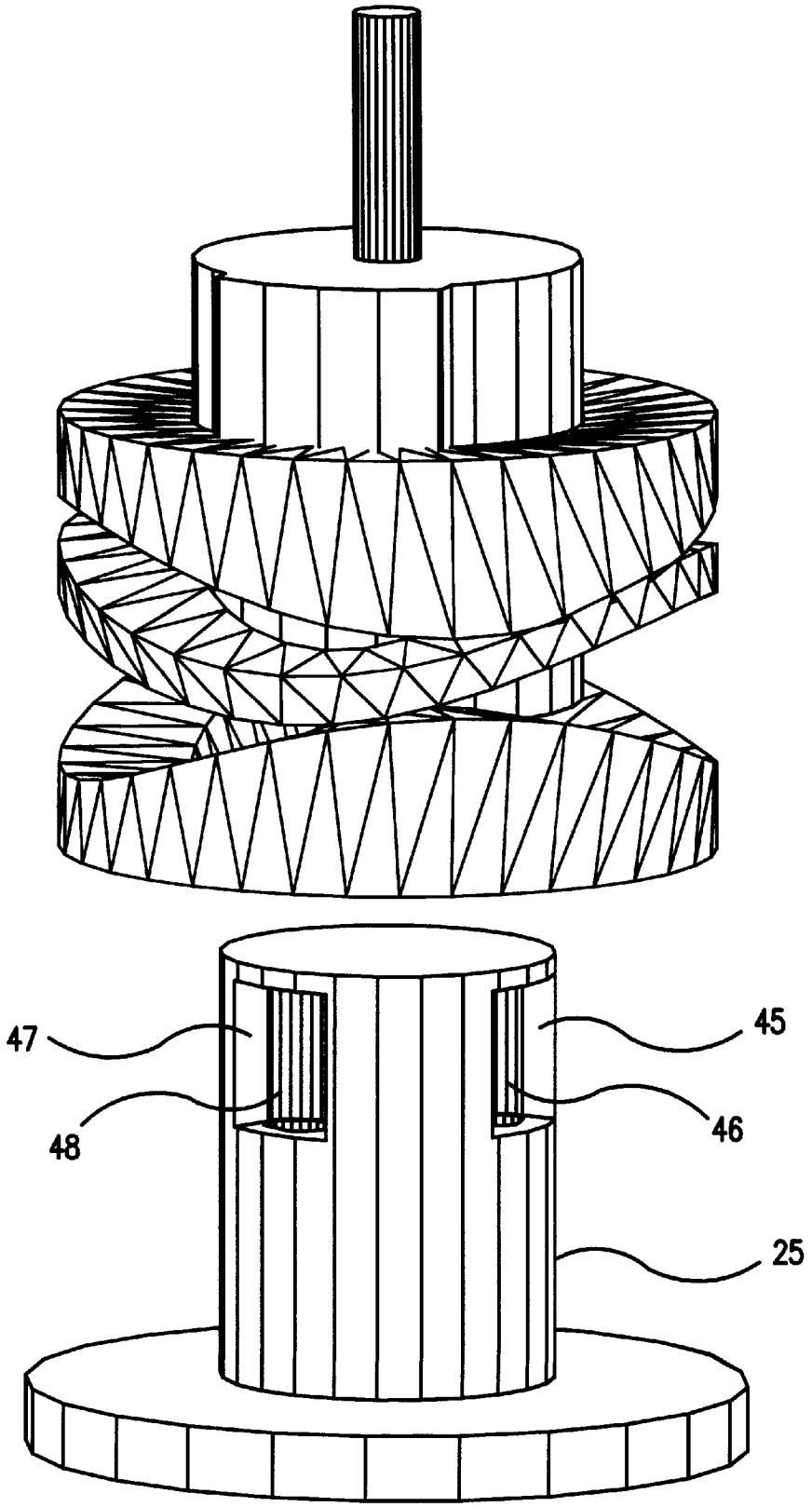
FIG. 7 shows an exploded view of the Deckard engine.

FIG. 7 shows an exploded view of the engine. The intake charge is introduced through an intake runner 48 to the intake port 47. Exhaust is removed through the exhaust port 45 and an exhaust runner 46.

Figure 8:
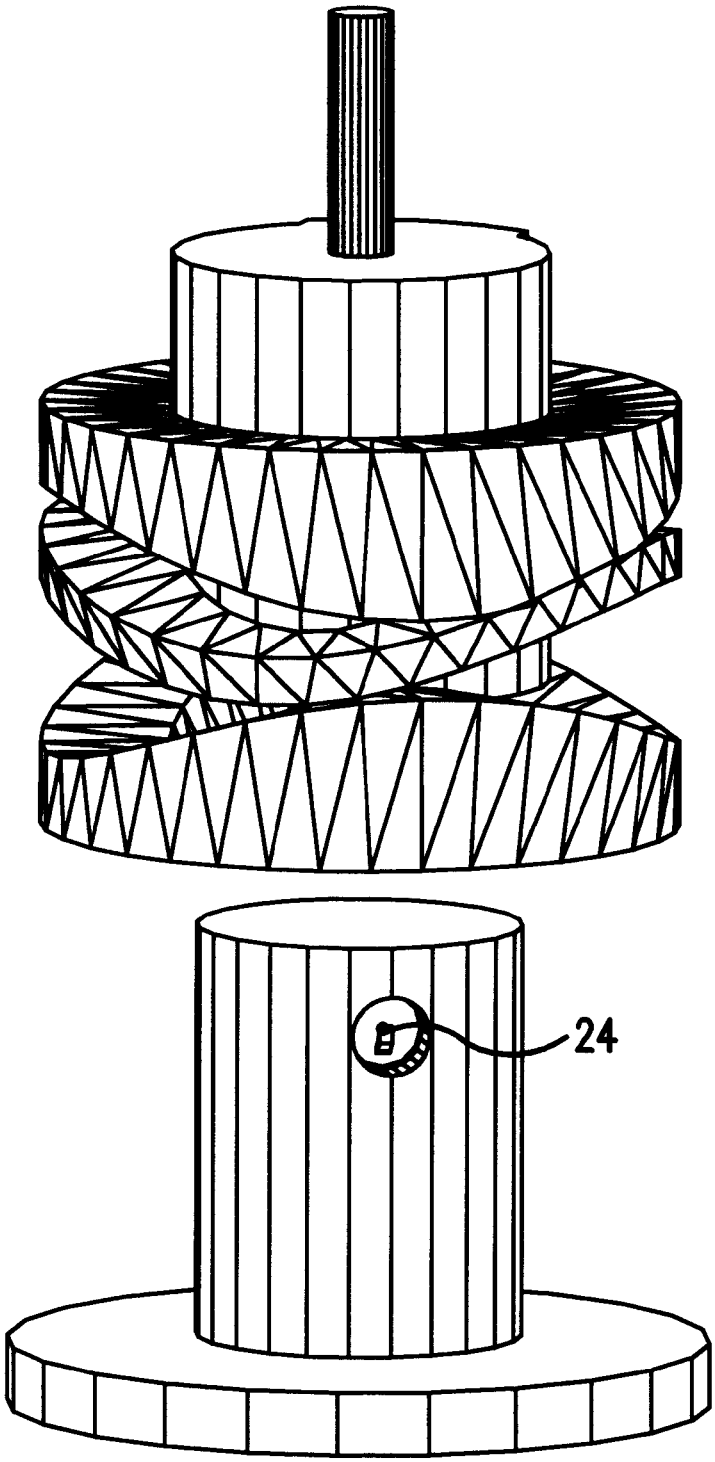
FIG. 8 shows an exploded view of the Deckard engine on the opposite side of the piston than shown in FIG. 7.

FIG. 8 shows an exploded view of the engine on the opposite side of the piston than shown in FIG. 7. In this embodiment, a spark plug 24 is used as an ignition device, although an ignition device is not always necessary because the fuel and the compression ratio can be selected to obtain compression ignition.

In the Deckard engine, typical planar or flat piston rings can only partially seal the cylinder. If a conventional ring is placed at a level above the ports, below the ports or both, it can limit downward blowby in the direction parallel to the symmetry axis of the piston, but can not effectively limit blowby in the direction towards the intake and exhaust ports. The reason for this limitation is that, unlike conventional engines, the space of high pressure gasses during compression and expansion is expanded at the side of the piston as well as the top of the piston due to the existence of the transfer port.

Figure 1:
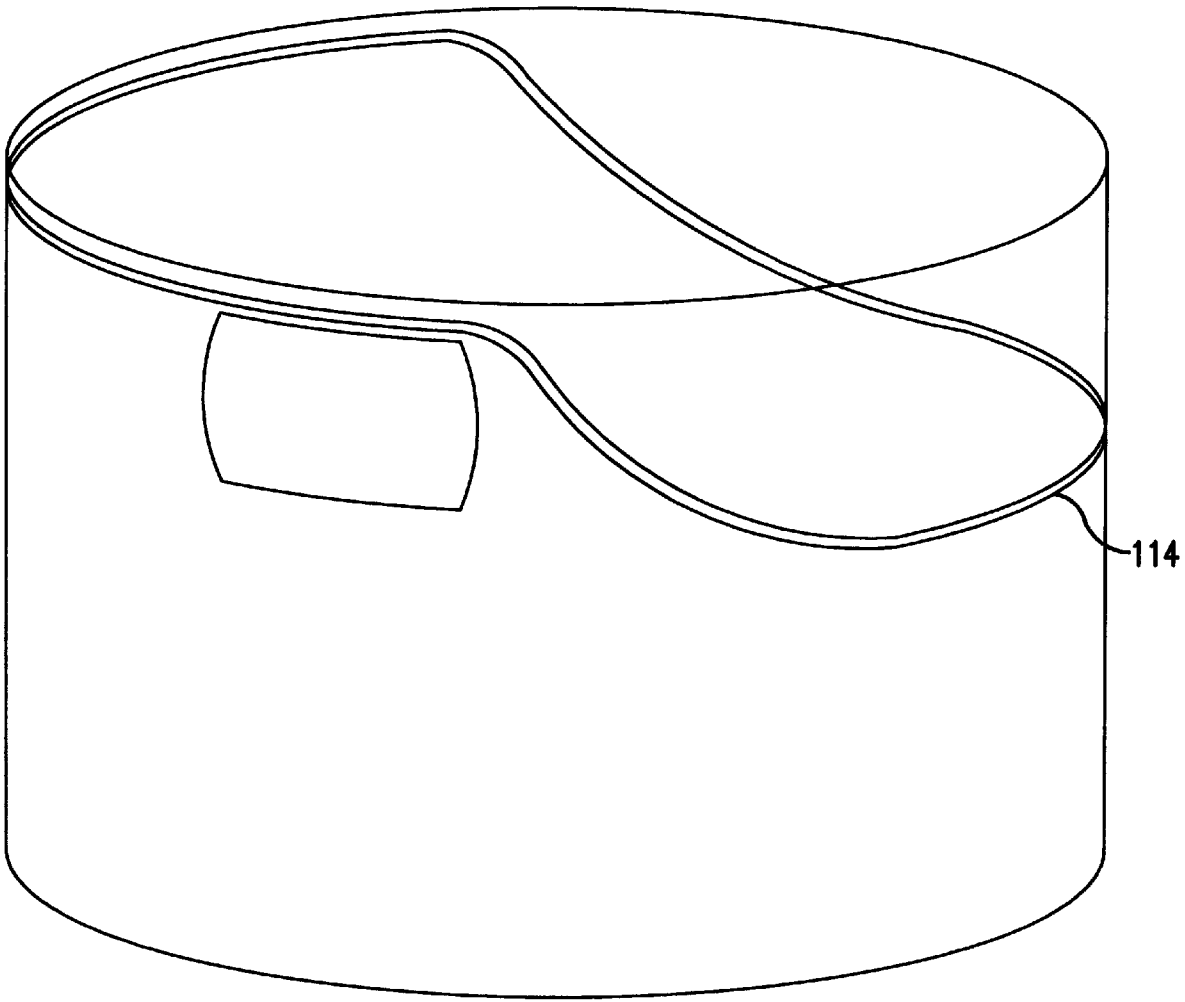
FIG. 1 is a perspective view of a non-planar ring slot for a Deckard engine.

Referring now to FIG. 1, a compression ring 114 of a non-planar shape is located inside a similarly shaped groove in order to improve the sealing in the Deckard engine. This ring drops below port level in the part of the piston where the transfer port descends during the compression stroke. The ring remains at this low level for such a portion of the piston periphery such that isolates the transfer port from the piston ports for the largest portion of the compression and power strokes. This ring is split and preferably follows the conventions of ring design with respect to end-gap and pre-load parameters. For example, the pre-load is preferably in the order of 25 psi pressure on the cylinder walls when assembled, and the end gap in the order of 0.005 inches, In a conventional piston ring, the high pressure gas forces the ring towards the liner thereby achieving a relatively tight seal between the compression ring and the liner. Furthermore, the high gas pressure also forces the compression ring against the lower part of its piston groove, thereby achieving a secondary sealing of a relatively tight seal between the piston and ring. In those "flat" or planar rings, the bottom part of the compression ring fits relatively well on the also flat lower side of the groove. In the compression ring described above, although the curved lower ring surface and the groove have the same shape, minor rotations of the compression ring do not always allow satisfactory fit and thus seal.

Figure 2:
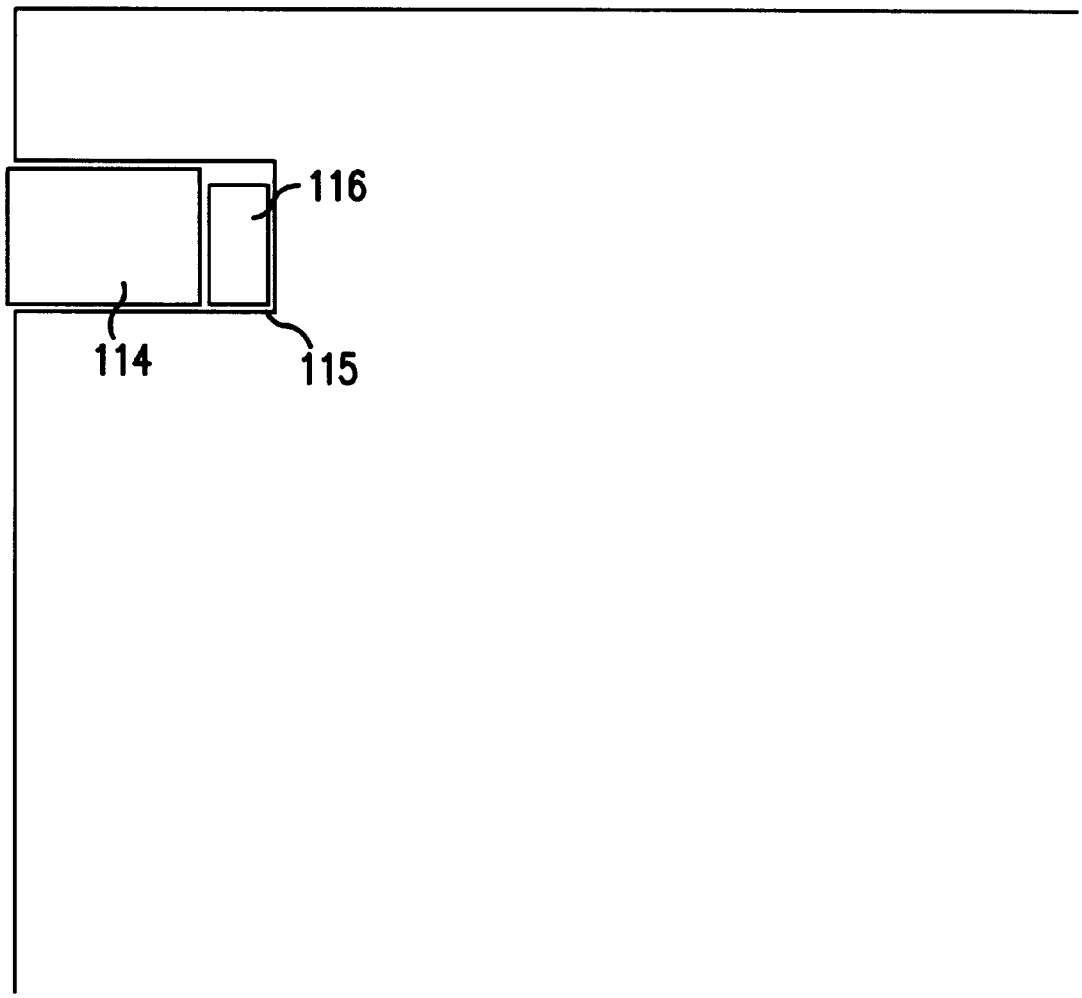
FIG. 2 is a cross-sectional view of a piston with a primary and secondary sealing ring.

Referring now to FIG. 2, in order to improve the secondary sealing between the compression ring 114 and the piston groove 115, a secondary sealing ring 116 is installed in the groove and behind the compression ring. This sealing means is preferably fabricated from a more compliant and flexible material, such as a high temperature elastomer like silicon rubber, than the cast iron or steel from which typical piston rings are typically fabricated. This secondary sealing ring will deform when assembled, and fill up the clearance while allowing the compression ring to move in and out in its groove. Its sealing action is similar to an O-ring.

Alternatively, the secondary sealing ring can be constructed of metal in a geometry that provides compliance. Metal O rings formed from thin wall tubing, metal C rings, and metal U rings are familiar to those skilled in the art of high temperature sealing. Examples of these compliant metal seals can be found in the "Seals For Extreme Environments Design Manual" from Advanced Products Company. Thus, the piston ring which is made out of a relatively hard material takes the rubbing against the liner sliding seal, while the compliant secondary sealing ring achieves the secondary sealing without being subject to the static seal rubbing.

The secondary sealing ring can also be used in order to provide part or all of the pre-load.

Alternative Embodiment, Gapped Non-Planar Ring

Alternately, a gapped non-planar ring can be used without the secondary seal.

Alternative Embodiment, Gapless Non-Planar Ring

Due to space limitations, it will be difficult to incorporate more than one compression ring of the non-planar form in the Deckard engine. In order to further reduce blowby, and since it is generally recognized that most of the blowby gasses flow through the ring end-gaps, the non-planar ring can be designed without end-gap in a gapless compression ring. Due to the non-planar shape of the ring, a certain amount of flexibility is inherent. This flexibility will provide the in-and-out freedom necessary in a typical compression ring. The ring groove is wide enough such that the clearance between the groove and the ring in the direction parallel to the piston axis of symmetry is higher than the 0.002 to 0.003 inches in typical pistons, especially around the areas of high groove curvature. This extra width will allow the in-and-out motion with minimal interference. The secondary sealing ring that provides the pre-load on the ring with gap also provides a pre-load for the gapless case. Furthermore, the ring itself is more flexible than usual. Assembly can be achieved either by deforming the ring elastically by hand or by making the piston of this engine in two or more pieces which will be assembled after the non-planar gapless ring and secondary sealing ring are already in place.

One of the functions of typical piston rings is to achieve sealing while allowing freedom of piston motion normal to the sliding direction. For example, when the piston is subject to a side load such as that imposed through the connecting rod forces for a conventional engine, the piston is pushed on one side allowing the hydrodynamic lubricant film between the piston and liner on the low clearance side to take the load. Typically, the ring loading is not affected by this type of piston motion because it is free to move within its groove. In the case of the non-planar ring with the secondary sealing ring, this type of piston motion will have some effect on the ring loading because the strain of the secondary sealing ring will increase on the low clearance side, causing the load between the ring and liner to increase on the same side. In order to reduce the severity of this problem, the secondary sealing ring is designed in such a way such that the pre-load deformation and strain is much higher than the deformation that can be caused by the side movement of the piston which is typically in the order of one to five thousands of an inch. One way of achieving this is objective is with a secondary seal having a relatively large cross sectional area. In this case, the deformation of the elastomer is relatively large to accomplish the same pre-load. Thus, this type of piston offset will have small effect on the ring loading.

Alternative Embodiment, Gapless Sheet Metal Ring

Figure 3:
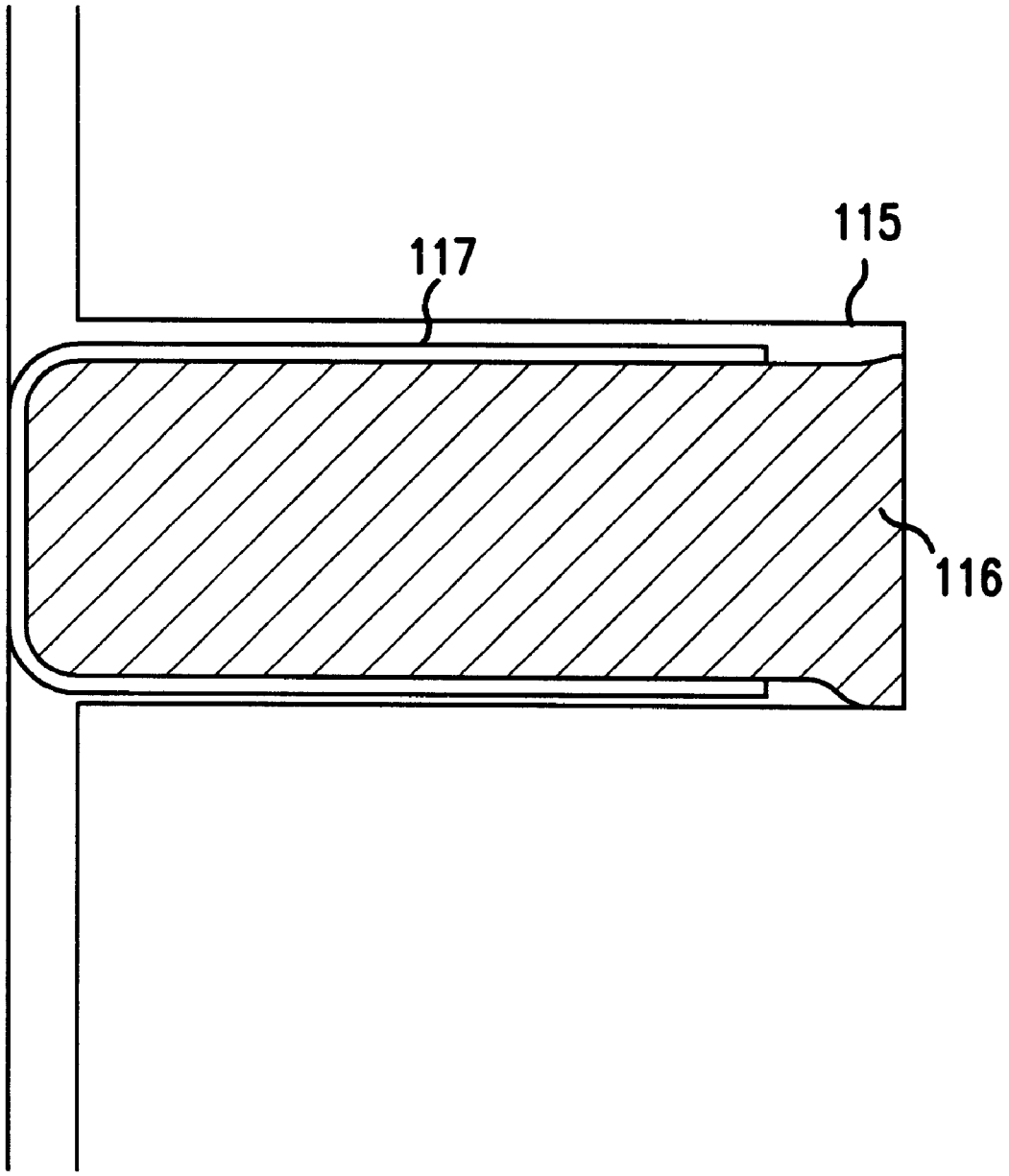
FIG. 3 is a cross-sectional view of a piston and cylinder wall with a ring having a metal wear cover and a compliant secondary seal.

Another method of achieving a gapless non-planar ring, with the possibility of easier assembly, is shown on FIG. 3. Again, the secondary sealing ring 116 is fit on the piston groove 115. However, instead of a piston ring, a piece of sheet-metal 117 is carefully assembled around the secondary sealing ring as shown, before the cylinder is installed on the piston. This sheet-metal wear cover is made by a relatively hard material such as steel or brass such that it can take the rubbing with the cylinder wall and achieve the sliding seal without durability problems. The wear cover can be a straight piece cut at the appropriate length, such that when wrapped around the secondary sealing ring, it will allow a small gap of a magnitude typical for ring end gaps. However, in contrast to a typical compression ring where the end gap runs all along the radial width of the ring, the end gap on the ring of FIG. 3 will be confined to the thickness of the sheet-metal used to make the wear cover 117.

Alternative Embodiment, Sealing in a Conventional Engine

The secondary sealing ring concept can be used for conventional engines. Sometimes, during certain operating conditions in conventional engines, typically during light load, high speed operation, the phenomenon called "ring flutter" is known to exist. During ring flutter, friction and inertia forces dominate over pressure forces and cause the top or second compression ring to move up and down in its grove. There are two consequences of ring flutter. First, the secondary sealing is interrupted and the blowby is temporarily increased with subsequent loss of efficiency. Second, the up and down motion of the ring can cause oil pumping towards the combustion chamber thereby temporarily increasing oil consumption. The application of the secondary sealing ring behind the ring on a conventional engine will reduce or eliminate both consequences of ring flutter. For certain applications where the top compression ring is too hot for a secondary sealing ring, for example in certain diesel engines, the secondary sealing ring can be applied to the second ring which is typically cooler.

Alternative Embodiment, Non-Planar Gapless Ring on a Conventional Engine

Figure 9:
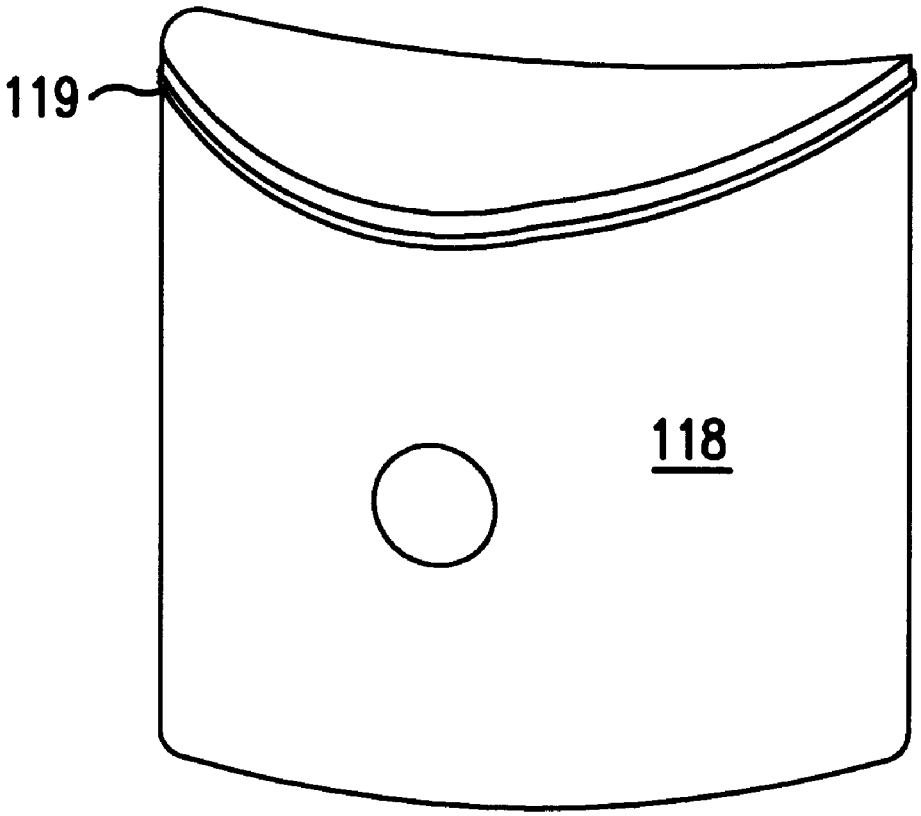
FIG. 9 shows a piston for a conventional engine with a non-planar ring.

In an alternative embodiment, a non-planar gapless compression ring as described for the Deckard engine is employed for a conventional engine. This gapless compression ring may be used with or without the compliant secondary sealing ring. FIG. 9 shows a piston for a conventional engine 118 with a non-planar 119. In this case, the purpose of the curvature is to eliminate the end gap in order to reduce emissions.

What is claimed is:

1. A four-stroke internal combustion engine having an inlet and an exhaust comprised of:

a generally fixed piston, such that the piston has an outer surface, and such that the outer surface has at least one non-planar sealing ring groove;

a hollow cylinder having one closed end, the cylinder having an inner diameter approximately the same as the diameter of the piston, and configured such that the cylinder overlaps the piston, so that the cylinder may rotate and translate relative to the piston;

a chamber between the piston and the closed end of the cylinder, such that the volume of the chamber can be varied by the translation of the cylinder relative to the piston;

a cam means which couples the translation of the cylinder to its rotation;

at least one opening in the piston which serves as an intake port;

at least one opening in the piston which serves as an exhaust port;

at least one recess in the hollow cylinder which serves as a transfer port;

such that the piston intake port and cylinder transfer port are in periodic registry during the cylinder rotation to allow fluid to enter the chamber through the intake port and transfer port, and such that the piston exhaust port and cylinder transfer port are in periodic registry during the cylinder rotation to allow fluid to exit the chamber through the transfer port and the exhaust port; and at least one non-planar primary sealing ring, such that the sealing ring is substantially contained in the non-planar sealing ring groove.

2. The engine of claim 1 wherein there is a compliant secondary sealing ring, such that the compliant secondary sealing ring is contained within the non-planar groove behind the primary sealing ring.

3. The engine of claim 2 wherein the secondary sealing ring has a pre-load deformation.

4. The engine of claim 2 wherein the non-planar sealing ring is integral to the secondary sealing ring, such that the non-planar sealing ring partially encloses the secondary sealing ring.

5. The engine of claim 1 wherein the non-planar sealing ring is gapless.

6. A method of sealing between a generally fixed piston and a hollow cylinder which rotates and translates relative to the piston in an internal combustion engine having an intake port, an exhaust port, and a transfer port, the method comprising the steps of:

forming a non-planar groove around the piston;

placing a primary compression ring in the groove; and operating the engine so that compressed combustion gases force the primary compression ring to form a seal between the piston and the cylinder wall, and such that the seal encompasses the transfer port contents during at least the majority of the compression and power strokes.

7. The method of claim 6 comprising the additional steps of:

placing a compliant secondary sealing ring in the groove; such that the secondary sealing ring is located behind the primary compression ring; and operating the engine so that compressed combustion gases force the compliant secondary sealing ring to form a seal between the groove and the primary compression ring.

* * * * *